US006390393B1

(12) United States Patent
Bulgatz

(10) Patent No.: US 6,390,393 B1
(45) Date of Patent: May 21, 2002

(54) FUEL INJECTOR HAVING SPRING SEAT ALLOWING SPRING ROTATION AND ALIGNMENT

(75) Inventor: Dennis Bulgatz, Williamsburg, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/563,895

(22) Filed: May 3, 2000

(51) Int. Cl.[7] ..... B05B 1/30; F02M 51/00

(52) U.S. Cl. ..... 239/585.1; 239/585.2; 239/585.3; 239/585.4; 239/585.5

(58) Field of Search ..... 239/585.1, 585.3, 239/585.4, 585.5, 585.2; 251/337, 129.21

(56) References Cited

U.S. PATENT DOCUMENTS 4,116,389 A * 9/1978 Furtah et al. ..... 239/585.3
4,346,847 A * 8/1982 Rissi ..... 239/585.2
4,552,311 A * 11/1985 Casey ..... 239/551
4,655,396 A * 4/1987 Taxon et al. ..... 251/129.14
5,054,691 A * 10/1991 Huang et al. ..... 239/585.3
5,076,240 A * 12/1991 Perr ..... 239/88
5,605,289 A * 2/1997 Maley et al. ..... 239/585.1
6,032,651 A * 3/2000 Field ..... 123/467

* cited by examiner

*Primary Examiner*—Lesley D. Morris
*Assistant Examiner*—Davis Hwu

(57) ABSTRACT

The present invention provides a fuel injector having a fuel inlet, a fuel outlet, and a fuel passageway extending along an axis between the fuel inlet and the fuel outlet. The fuel injector includes a body having an inlet portion, an outlet portion, and a neck portion disposed between the inlet portion and the outlet portion. An armature is disposed within the neck portion of the body and displaceable along the axis relative to the body. A spring is disposed within the neck portion and applies a biasing force to the armature. The spring has a downstream end disposed proximate the armature and an upstream end opposite from the downstream end. An adjusting tube is disposed within the neck portion of the body and proximate to the upstream end of the spring. The adjusting tube varies the biasing force applied by the spring to the armature. A spring seat engages one of the spring ends and permits spring movement that counteracts parasitic forces arising due to compression and extension of the spring, and applies the biasing force substantially along the axis.

23 Claims, 3 Drawing Sheets

FUEL INJECTOR HAVING SPRING SEAT ALLOWING SPRING ROTATION AND ALIGNMENT

BACKGROUND OF THE INVENTION

This invention relates in general to a fuel injector assembly, and more specifically to a fuel injector assembly having at least one spring seat allowing spring rotation and alignment.

It is known to use a coil spring between an armature and an adjusting tube in a conventional fuel injector assembly. The spring is disposed between an end of the adjusting tube and a void in the armature. By this arrangement, the adjusting tube applies a reaction force on an upstream end of the spring, and the downstream end of the spring applies a biasing force on the armature.

One disadvantage of springs in conventional fuel injector assemblies is the increased frictional forces that are caused by the active coils of the spring rubbing against cavity walls (e.g., spring guides positioned inside of the coils or surrounding the coils) and by over-constraining the ends of the spring. Constraining the ends of coil springs to remain parallel during spring compression creates undesirable parasitic forces such as off-axis reaction forces and torques. As it is used in connection with the present invention, the expression "off-axis" refers to a direction that is not coincident with a centerline of the armature, i.e., the axis along which the armature moves.

The natural twisting of conventional fuel injector springs, which is caused by spring compression, can adversely affect injector performance by forcing the armature needle to rotate a prescribed amount during opening, and then rotate oppositely during closing. Thus, another disadvantage of conventional fuel injector spring arrangements is that the needle is prevented from freely rotating, thereby degrading sealing performance and increasing wear between the needle and its seat. Moreover, the off-axis reaction forces urge the armature away from optimum alignment, thus further degrading sealing performance, causing wear of the upper and lower armature guiding surfaces, and increasing wear between the needle and the seat.

For these reasons, it is desirable to counteract the effect of parasitic forces by allowing movement of a fuel injector assembly spring so as to substantially eliminate the effect of off-axis forces, and without increasing the frictional forces on the spring.

SUMMARY OF THE INVENTION

An object of the present invention is to eliminate or minimize the effect of parasitic forces resulting from the compression and extension of a coil spring in a fuel injector. Another object is for a fuel injector spring to generate a biasing force that is substantially coaxial with the movement of a fuel injector armature.

The present invention provides a fuel injector having a fuel inlet, a fuel outlet, and a fuel passageway extending along an axis between the fuel inlet and the fuel outlet. The fuel injector comprises a body having an inlet portion, an outlet portion, and a neck portion disposed between the inlet portion and the outlet portion; an armature disposed within the neck portion of the body and displaceable along the axis relative to the body; a spring disposed within the neck portion and applying a biasing force to the armature, the spring having a downstream end disposed proximate the armature and an upstream end opposite from the downstream end; an adjusting tube disposed within the neck portion of the body and proximate to the upstream end of the spring, the adjusting tube varying the biasing force applied by the spring to the armature; and a first spring seat engaging a first one of the downstream and upstream ends, the spring seat permitting spring movement counteracting parasitic forces arising due to spring compression and extension.

The present invention also provides a method of forming a fuel injector having a fuel inlet, a fuel outlet, a fuel passageway extending along an axis between the fuel inlet and the fuel outlet. The fuel injector including a body having an inlet portion, an outlet portion, a neck portion extending between the inlet portion and the outlet portion, an adjusting tube, and an armature. The method comprises disposing an armature displaceable along the axis relative to the body within the neck portion; disposing a spring applying a biasing force to the armature within the neck portion, the spring having a downstream end disposed proximate the armature and an upstream end opposite from the downstream end; and providing a first spring seat engaging a first one of the downstream and upstream ends of the spring, the first spring seat permitting spring movement such that the biasing force is applied substantially along the axis.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENTS

Figure 1:
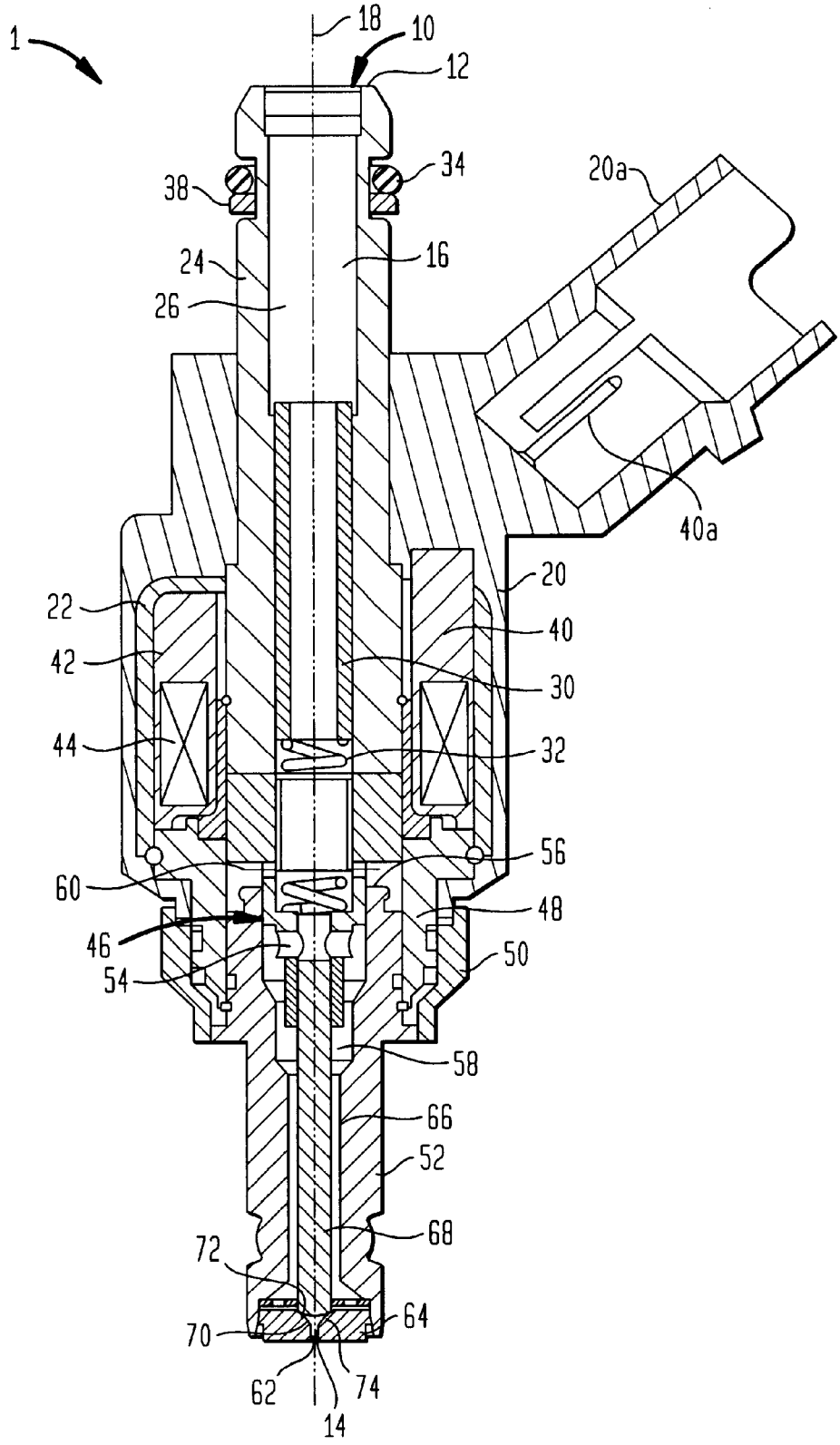
FIG. 1 is a cross-sectional view of a conventional fuel injector assembly.

FIG. 1 shows a fuel injector assembly 1 that has a sub-assembly 10 including a fuel inlet 12, a fuel outlet 14, and a fuel passageway 16 extending from the fuel inlet 12 to the fuel outlet 14 along a longitudinal axis 18. The fuel injector assembly 1 also includes an overmolded plastic member 20 cincturing a metallic support member 22.

A fuel inlet member 24 with an inlet passage 26 is disposed within the overmolded plastic member 20. The inlet passage 26 serves as part of the fuel passageway 16 of the fuel injector assembly 1. A fuel filter (not shown) and an adjusting tube 30 are provided in the inlet passage 26. The adjusting tube 30 is positionable along the longitudinal axis 18 before being secured in place, thereby varying the length of an armature bias spring 32. The armature bias spring 32 can be a coil spring. In combination with other factors, the length of the spring 32, and hence the bias force of the spring 32, affects the quantity of fuel flow through the injector. The overmolded plastic member 20 also supports a socket 20*a* that receives a plug (not shown) to operatively connect the fuel injector assembly 1 to an external source of electrical potential, such as an electronic control unit (not shown). An elastomeric O-ring 34 is provided in a groove on an exterior of the inlet member 24. The O-ring 34 is supported by a backing ring 38 to sealingly secure the inlet member 24 to a fuel supply member (not shown), such as a fuel rail.

The metallic support member 22 encloses a coil assembly 40. The coil assembly 40 includes a bobbin 42 that retains a coil 44. The ends of the coil assembly 40 are electrically connected to pins 40*a* mounted within the socket 20*a* of the overmolded plastic member 20. An armature 46 is supported for relative movement along the axis 18 with respect to the inlet member 24. The armature 46 is supported by a spacer 48, a body shell 50, and a body 52. The armature 46 has an armature passage 54 in fluid communication with the inlet passage 26.

The spacer 48 engages the body shell 50, which engages the body 52. An armature guide eyelet 56 is located on an inlet portion 60 of the body 52. An axially extending body passage 58 connects the inlet portion 60 of the body 52 with an outlet portion 62 of the body 52. The armature passage 54 of the armature 46 is in fluid communication with the body passage 58 of the body 52. A seat 64, which can be constructed of a metallic material, is mounted at the outlet portion 62 of the body 52.

The body 52 includes a neck portion 66 that extends between the inlet portion 60 and the outlet portion 62. The neck portion 66 can be an annulus that surrounds a needle 68. The needle 68 is operatively connected to the armature 46, and can be a substantially cylindrical needle 68. The cylindrical needle 68 is centrally located within and spaced from the neck portion so as to define a part of the body passage 58. The cylindrical needle 68 is substantially axially aligned with the longitudinal axis 18 of the fuel injector assembly 1.

Operative performance of the fuel injector assembly 1 is achieved by magnetically coupling the armature 46 to the end of the inlet member 26 that is closest to the inlet portion 60 of the body 52. Thus, the lower portion of the inlet member 26 that is proximate to the armature 46 serves as part of the magnetic circuit formed with the armature 46 and coil assembly 40. The armature 46 is guided by the armature guide eyelet 56 and is responsive to an electromagnetic force generated by the coil assembly 40 for axially reciprocating the armature 46 along the longitudinal axis 18 of the fuel injector assembly 1. The electromagnetic force is generated by current flow from the electronic control unit (not shown) through the coil assembly 40. Movement of the armature 46 also moves the operatively attached needle 68 to positions that are either separated from or contiguously engaged with the seat 64. This opens or closes, respectively, the seat passage 70 of the seat 64, which permits or prevents, respectively, fuel from flowing through the fuel outlet 14 of the fuel injector assembly 1. The needle 68 includes a curved surface 74, which can have a partial spherical shape for contiguously engaging with a conical portion 72 of the seat passage 70. Of course, other contours for the tip of the needle 68 and the seat passage 70 may be used provided that, when they are engaged, fuel flow through the seat 64 is prevented.

Fuel that is to be injected from the fuel injector assembly 1 is communicated from the fuel inlet source (not shown), to the fuel inlet 12, through the fuel passageway 16, and exits from the fuel outlet 14. The fuel passageway 16 includes the inlet passage 26 of the inlet member 24, the armature passage 54 of the armature 46, the body passage 58 of the body 52, and the seat passage 70 of the seat 64.

Figure 2:
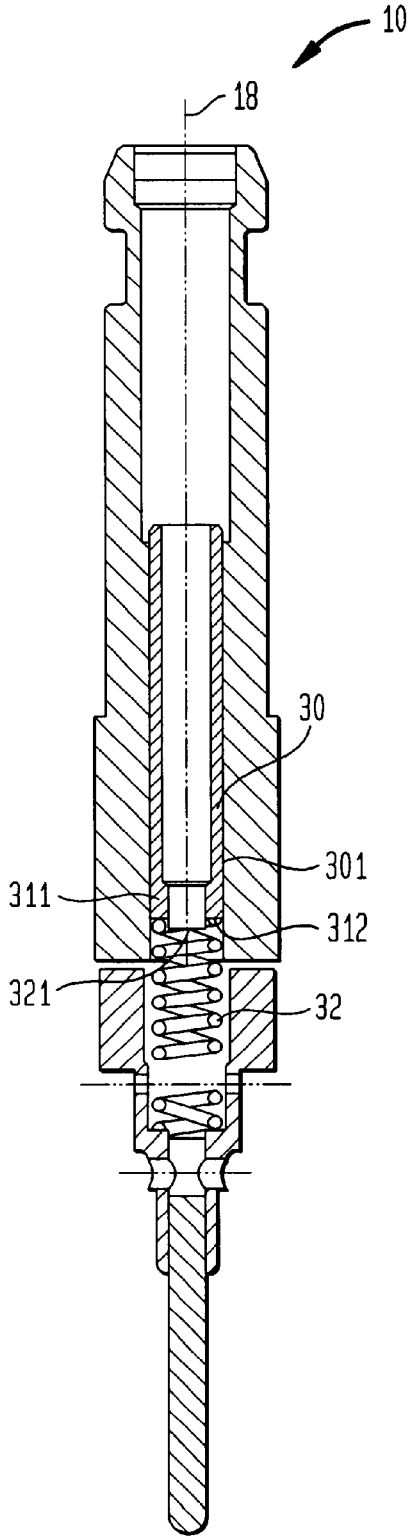
FIG. 2 is a cross-sectional view of a conventional fuel injector sub-assembly.

Referring now to FIG. 2, the adjusting tube 30 of the fuel injector sub-assembly 10 includes a spring seat 301. The spring seat 301 includes a flange 311 having a face 312 that engages an upstream side of the spring 32 and can include a projection 321. The projection 321 of the spring seat 301 can center the end of the spring 32 with respect to the axis 18. The flange 311 and the projection 321 of the spring seat 301 can be annular, thereby permitting fluid communication through the spring seat 301.

Figure 3:
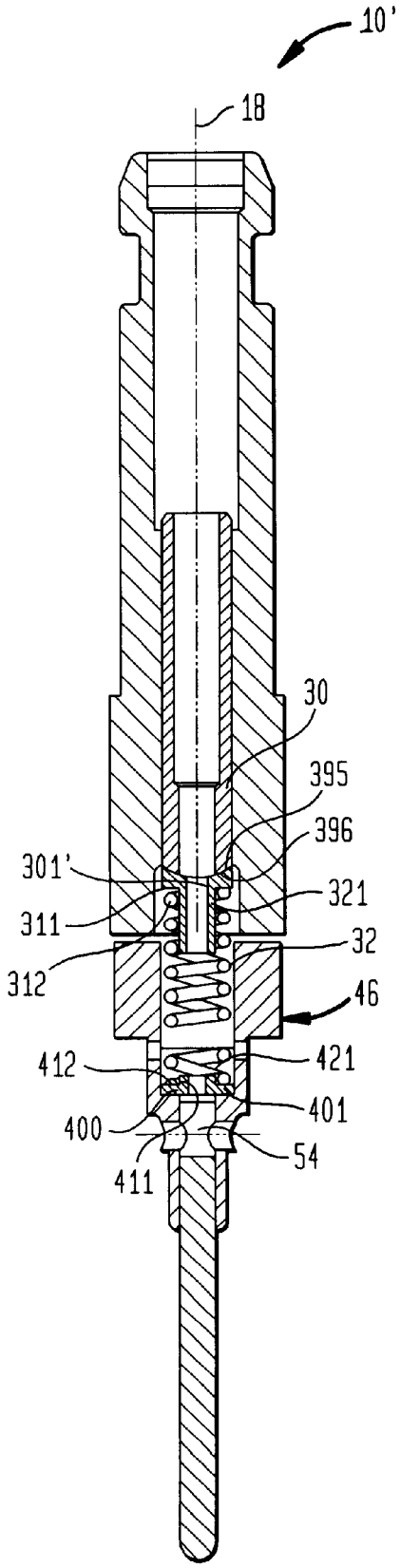
FIG. 3 is a cross-sectional view of an embodiment of a fuel injector sub-assembly according to the present invention.

Referring now to FIG. 3, a fuel injector sub-assembly 10' according to the present invention includes an independent first spring seat 301' disposed adjacent to the adjusting tube 30 and a second spring seat 401 disposed adjacent to the armature passage 54.

The adjusting tube 30 includes a generally convex surface 395, and the spring seat 301' includes a flange 311 having a generally concave surface 396 cooperatively engaging the convex surface 395. The surfaces 395,396 are smooth, e.g., ground and polished, to facilitate relative sliding movement between the adjusting tube 30 and the spring seat 301'. The flange 311 of the spring seat 301' also includes a face 312 that engages an upstream side of the spring 32. A projection 321 from the face 312 can center the upstream end of the spring 32 with respect to the axis 18. The projection 321 can be tapered such that only inactive coils of the spring 32 are engaged/guided. The extended length of the projection 321 also allows easier handling and orientation of the spring seat 301' during assembly.

During operation of the fuel injector sub-assembly 10', the surfaces 395,396 allow the combination of the spring 32 and the seat 301' to slide substantially freely with respect to the adjusting tube 30. This relative sliding facilitates relative rotation about the axis 18, relative swivelling between the seat 301' and the adjusting tube 30, or any combination of relative rotation and swivelling. As it is used in connection with the present invention, the term "swivel" refers to the ability to change the relative angular orientation in any plane that includes the axis 18.

The flange 311 and the projection 321 of the spring seat 301' can be annular, thereby permitting fluid communication through the spring seat 301'. Of course, the concave and convex surfaces can be reversed such that the adjusting tube includes a generally concave surface and the flange includes a cooperating convex surface.

The second spring seat 401 includes a flange 411 contiguously engaging the armature 46 at an interface therebetween. This interface, which includes smooth, e.g., ground and polished, cooperatively engaging surfaces, allows relative sliding between the second spring seat 401 and the armature 46. These cooperatively engaging surfaces can be planar, thereby facilitating relative rotation about the axis 18.

The flange 411 of the second spring seat 401 also includes a face 412 which substantially engages a downstream end of the spring 32, and can include a projection 421 extending from the face 412 for centering the downstream end of the spring 32 with respect to the axis 18. The flange 411 and the projection 421 can be annular, thereby permitting fluid communication through the second spring seat 401.

According the fuel injector assembly 10', the off-axis forces or torques that are generated by compressing and relaxing the spring 32 are substantially counteracted by: 1) rotation of the first spring seat 301', the second spring seat 401, and the spring 32, as a unit, about the axis 18, or 2)

relative swivelling of the first spring seat 301' with respect to the adjusting tube 32.

Figure 4:
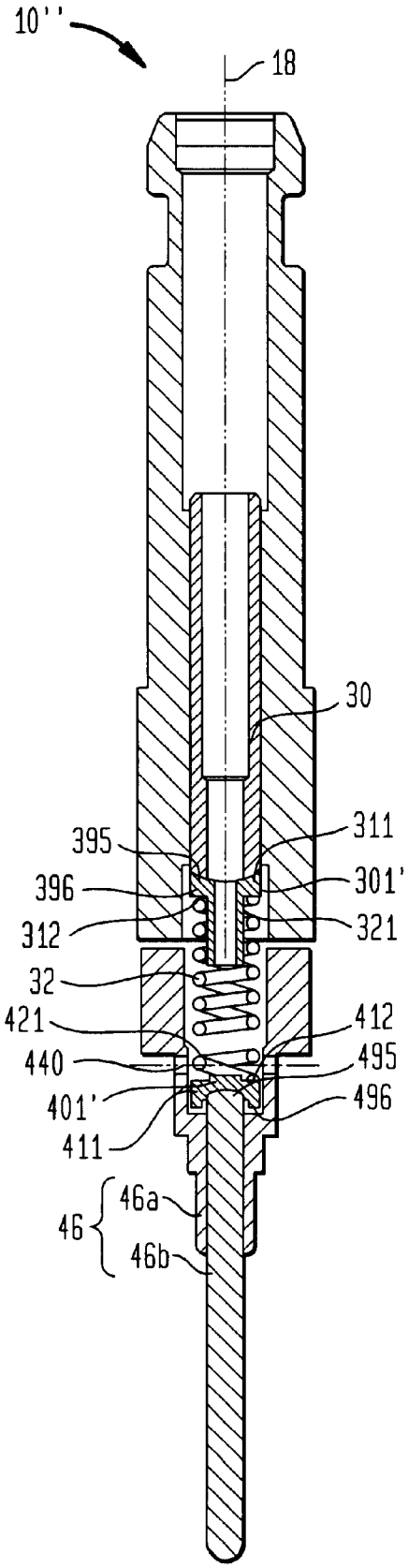
FIG. 4 is a cross-sectional view of another embodiment of a fuel injector sub-assembly according to the present invention.

Referring now to FIG. 4, the armature 46 of another alternate fuel injector assembly 10" according to the present invention can include an armature body 46*a* secured to a needle 46*b*. The needle 46*b* can have a generally convex surface 495 cooperatively engaging a second spring seat 401' having a generally concave surface 496 on the flange 411. The surfaces 495,496 are smooth, e.g., ground and polished, to facilitate relative sliding movement between the needle 46*b* and the second spring seat 401'. The arrangement of the first spring seat 301' is generally the same as that described with respect to the fuel injector assembly 10'.

Thus, the fuel injector assembly 10" substantially counteracts the off-axis forces or torques that are generated by compressing and relaxing the spring 32 by: 1) rotation of the first spring seat 301', the second spring seat 401', and the spring 32, as a unit, about the axis 18, or 2) relative swivelling of the first or second spring seats 301',401' with respect to the adjusting tube 32 or the needle 46*b* of the armature 46, respectively.

As it is shown in FIG. 4, the fuel injector assembly 10" can also differ from the fuel injector assembly 10' shown in FIG. 3 in that the second spring seat 401' is not annular. That is to say, fluid communication through the spring seat 401' is prevented. Instead, fuel flow through the fuel injector assembly 10" is diverted to one or more holes 440 extending radially through the armature body 46*a*.

Figure 5:
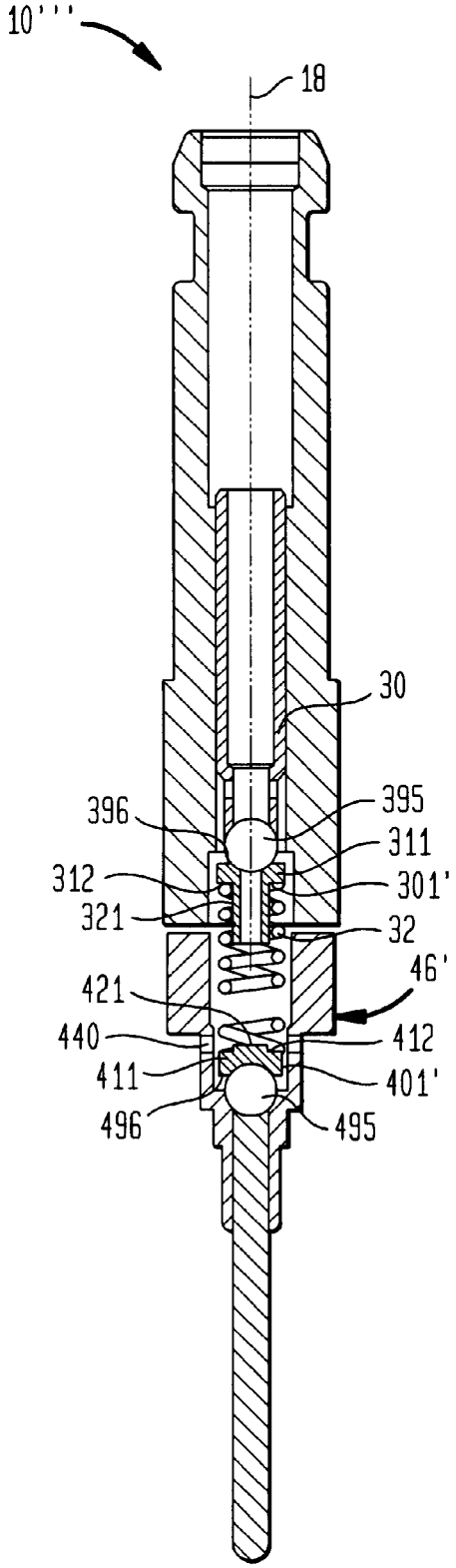
FIG. 5 is a cross-sectional view of another embodiment of a fuel injector sub-assembly according to the present invention.

Referring now to FIG. 5, yet another alternate fuel injector assembly 10'" includes an armature 46' having a generally convex surface 495 that is at least a portion of a sphere, e.g., a ball bearing. Otherwise, the fuel injector assembly 10'" and its operation are substantially similar to the fuel injector assembly 10" shown in FIG. 4.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A fuel injector having a fuel inlet, a fuel outlet, and a fuel passageway extending along an axis between the fuel inlet and the fuel outlet, the fuel injector comprising:

a body having an inlet portion, an outlet portion, and a neck portion disposed between the inlet portion and the outlet portion;

an armature disposed within the neck portion of the body and displaceable along the axis relative to the body;

a spring disposed within the neck portion and applying a biasing force to the armature, the spring having a downstream end disposed proximate the armature and an upstream end opposite from the downstream end;

an adjusting tube disposed within the neck portion of the body and proximate to the upstream end of the spring, the adjusting tube varying the biasing force applied by the spring to the armature; and a first spring seat engaging a first one of the downstream and upstream ends, the spring seat permitting spring movement counteracting parasitic forces arising due to spring compression and extension.

2. The fuel injector according to claim 1, wherein the first spring seat has a substantially concave surface slidably engaging a substantially convex surface on one of the armature and the adjusting tube.

3. The fuel injector according to claim 1, wherein the spring comprises a coil spring.

4. The fuel injector according to claim 3, wherein the first spring seat is adapted to substantially center the coil spring on the axis.

5. The fuel injector according to claim 3, wherein the first spring seat further comprises a flange engaging the first one of the downstream and upstream ends, and a projection extending from the flange and within the coil spring.

6. The fuel injector according to claim 5, wherein the projection tapers inwardly as the projection extends from the flange.

7. The fuel injector according to claim 1, wherein the first spring seat is annular so as to permit fluid communication through the first spring seat.

8. A fuel injector having a fuel inlet, a fuel outlet, and a fuel passageway extending along an axis between the fuel inlet and the fuel outlet, the fuel injector comprising:

a body having an inlet portion, an outlet portion, and a neck portion disposed between the inlet portion and the outlet portion;

an armature disposed within the neck portion of the body and displaceable along the axis relative to the body;

a spring disposed within the neck portion and applying a biasing force to the armature, the spring having a downstream end disposed proximate the armature and an upstream end opposite from the downstream end;

an adjusting tube disposed within the neck portion of the body and proximate to the upstream end of the spring, the adjusting tube varying the biasing force applied by the spring to the armature; and a first spring seat engaging a first one of the downstream and upstream ends, the spring seat permitting spring movement counteracting parasitic forces arising due to spring compression and extension, wherein the first spring seat permits the downstream end of the spring to rotate about the axis relative to the upstream end.

9. A fuel injector having a fuel inlet, a fuel outlet, and a fuel passageway extending along an axis between the fuel inlet and the fuel outlet, the fuel injector comprising:

a body having an inlet portion, an outlet portion, and a neck portion disposed between the inlet portion and the outlet portion;

an armature disposed within the neck portion of the body and displaceable along the axis relative to the body;

a spring disposed within the neck portion and applying a biasing force to the armature, the spring having a downstream end disposed proximate the armature and an upstream end opposite from the downstream end;

an adjusting tube disposed within the neck portion of the body and proximate to the upstream end of the spring, the adjusting tube varying the biasing force applied by the spring to the armature;

a first spring seat engaging a first one of the downstream and upstream ends, the spring seat permitting spring movement counteracting parasitic forces arising due to spring compression and extension; and a second spring seat engaging a second one of the downstream and upstream ends, the second spring seat permitting spring movement counteracting parasitic forces arising due to spring compression and extension.

10. The fuel injector according to claim 9, wherein at least one of the first and second spring seat have a substantially concave surface slidably engaging a substantially convex surface of a corresponding one of the armature and the adjusting tube.

11. The fuel injector according to claim 9, wherein the first spring seat has a first substantially concave surface slidably engaging a first substantially convex surface on the adjusting tube, and the second spring seat has a second substantially concave surface slidably engaging a second substantially convex surface on the armature.

12. The fuel injector according to claim 11, wherein at least one of the first and the second substantially concave surfaces comprises a portion of a sphere.

13. The fuel injector according to claim 11, wherein the at least one of the first and the second substantially concave surfaces comprises a portion of a ball bearing.

14. The fuel injector according to claim 9, wherein the first spring seat has a first substantially concave surface slidably engaging a first substantially convex surface on the adjusting tube and the armature includes a needle, the second spring seat has a second substantially concave surface slidably engaging a second substantially convex surface on the needle.

15. The fuel injector according to claim 9, wherein the first spring seat has a first face engaging the upstream end of the spring, and the second spring seat has a second face engaging the downstream end of the spring.

16. The fuel injector according to claim 9, wherein the first spring seat has a first projection extending within the upstream end of the spring, and the second spring seat has a second projection extending within the downstream end of the spring.

17. The fuel injector according to claim 9, wherein at least one of the first and second spring seats is annular so as to permit fluid communication therethrough.

18. A method of forming a fuel injector having a fuel inlet, a fuel outlet, a fuel passageway extending along an axis between the fuel inlet and the fuel outlet, a body having an inlet portion, an outlet portion, a neck portion extending between the inlet portion and the outlet portion, an adjusting tube, and an armature, the method comprising:

disposing an armature displaceable along the axis relative to the body within the neck portion;

disposing a spring applying a biasing force to the armature within the neck portion, the spring having a downstream end disposed proximate the armature and an upstream end opposite from the downstream end;

providing a first spring seat engaging a first one of the downstream and upstream ends of the spring, the first spring seat permitting spring movement such that the biasing force is applied substantially along the axis, wherein the first spring seat permits the spring to rotate with the first spring seat about the axis.

19. A method of forming a fuel injector having a fuel inlet, a fuel outlet, a fuel passageway extending along an axis between he fuel inlet and the fuel outlet, body having an inlet portion, an outlet portion, a neck portion extending between the inlet portion and the outlet portion, an adjusting tube, and an armature, the method comprising:

disposing an armature displaceable along the axis relative to the body within the neck portion;

disposing a spring applying a biasing force to the armature within the neck portion, the spring having a downstream end disposed proximate the armature and an upstream end opposite from the downstream end;

providing a first spring seat engaging a first one of the downstream and upstream ends of the spring, the first spring seat permitting spring movement such that the biasing force is applied substantially along the axis, wherein the providing of the first spring includes providing a flange engaging the first one of the downstream and upstream ends, and providing a projection centering the spring with respect to the axis.

20. A method of forming a fuel injector having a fuel inlet, a fuel outlet, a fuel passageway extending along an axis between he fuel inlet and the fuel outlet, a body having an inlet portion, an outlet portion, a neck portion extending between the inlet portion and the outlet portion, an adjusting tube, and an armature, the method comprising:

disposing an armature displaceable along the axis relative to the body within the neck portion;

disposing a spring applying a biasing force to the armature within the neck portion, the spring having a downstream end disposed proximate the armature and an upstream end opposite from the downstream end;

providing a first spring seat engaging a first one of the downstream and upstream ends of the spring, the first spring seat permitting spring movement such that the biasing force is applied substantially along the axis, wherein the permitting of spring movement includes providing a first one of a convex surface and a concave surface on the first spring seat, and providing a second one of the convex and concave surfaces slidingly engaging the first one of the convex and concave surfaces.

21. A method of forming a fuel injector having a fuel inlet, a fuel outlet, a fuel passageway extending along an axis between he fuel inlet and the fuel outlet, a body having an inlet portion, an outlet portion, a neck portion extending between the inlet portion and the outlet portion, an adjusting tube, and an armature, the method comprising:

disposing an armature displaceable along the axis relative to the body within the neck portion;

disposing a spring applying a biasing force to the armature within the neck portion, the spring having a downstream end disposed proximate the armature and an upstream end opposite from the downstream end;

providing a first spring seat engaging a first one of the downstream and upstream ends of the spring, the first spring seat permitting spring movement such that the biasing force is applied substantially along the axis; and providing a second spring seat engaging a second one of the downstream and upstream ends of the spring, the second spring seat permitting spring movement such that the biasing force is applied substantially along the axis.

22. A fuel injector having a fuel inlet, a fuel outlet, and a fuel passageway extending along an axis between the fuel inlet and the fuel outlet, the fuel injector comprising:

a body having an inlet portion, an outlet portion, and a neck portion disposed between the inlet portion and the outlet portion;

an armature disposed within the neck portion of the body and displaceable along the axis relative to the body;

a spring disposed within the neck portion and applying a biasing force to the armature, the spring having a downstream end disposed proximate the armature and an upstream end opposite from the downstream end;

an adjusting tube disposed within the neck portion of the body and proximate to the upstream end of the spring, the adjusting tube varying the biasing force applied by the spring to the armature; and a first spring seat engaging a fist one of the downstream and upstream ends, the spring seat being permitted to move relative to the adjusting tube in response to spring movement.

23. A method of forming a fuel injector having a fuel inlet, a fuel outlet, a fuel passageway extending along an axis between the fuel inlet and the fuel outlet, a body having an inlet portion, an outlet portion, a neck portion extending between the inlet portion and the outlet portion, an adjusting tube, and an armature, the method comprising:

disposing an armature displaceable along the axis relative to the body within the neck portion;

disposing a spring applying a biasing force to the armature within the neck portion, the spring having a downstream end disposed proximate the armature and an upstream end opposite from the downstream end;

providing a first spring seat engaging a first one of the downstream and upstream ends of the spring, the first spring seat being permitted to move relative to the adjusting tube in response to spring movement.

* * * * *